United States Patent [19]

Nishikawa et al.

[11] Patent Number: 4,949,058

[45] Date of Patent: Aug. 14, 1990

[54] ELECTROMAGNETIC RELAY

[75] Inventors: Toyotaka Nishikawa, Tamaki; Kazuhiko Inoue, Misono, both of Japan

[73] Assignee: Matsushita Electric Works, Ltd., Japan

[21] Appl. No.: 452,503

[22] Filed: Dec. 19, 1989

[30] Foreign Application Priority Data

Dec. 23, 1988 [JP] Japan ..... 63-166932[U]
Oct. 2, 1989 [JP] Japan ..... 1-116095[U]

[51] Int. Cl.[5] ..... H01H 51/08

[52] U.S. Cl. ..... 335/128; 335/129; 335/275

[58] Field of Search ..... 335/128, 129, 132, 78, 335/79, 80, 84, 85, 274, 275

[56] References Cited

U.S. PATENT DOCUMENTS 4,689,587 8/1987 Schroeder ..... 335/128
4,720,694 1/1988 Schroeder ..... 335/128
4,851,802 7/1989 Koelling ..... 335/275

*Primary Examiner*—H. Broome
*Attorney, Agent, or Firm*—Stevens, Davis, Miller & Mosher

[57] ABSTRACT

An electromagnetic relay comprises an elongated coil bobbin having an axially extending bore and carrying therearound an excitation coil, a generally U-shaped yoke with first and second yoke members, and a generally U-shaped armature with short and long legs connected by a web. The yoke and the armature are magnetically coupled together partly within the axial bore of the coil bobbin to form a magnetic circuit with the excitation coil such that the armature is movable between a set position of closing a relay contact and a reset position of opening the relay contact. The first yoke member extends into the axial bore to define at its free end a first pole end while the second yoke member extending outwardly of the excitation coil to define a second pole end. The short armature leg extends into the bore in an overlying relation with the first pole end, while the long armature leg extends outwardly of the coil in adjacent relation to the second pole end. The armature defines a bearing edge at an inner corner between the web and the short leg and is pivotable relative to the yoke with the bearing end supported on a pivot edge formed at the end of the first pole end. A hinge spring is fitted into the axial bore of the coil bobbin to urge the bearing edge of the armature against the pivot edge of the yoke at an optimum contact pressure.

8 Claims, 6 Drawing Sheets

Fig.6
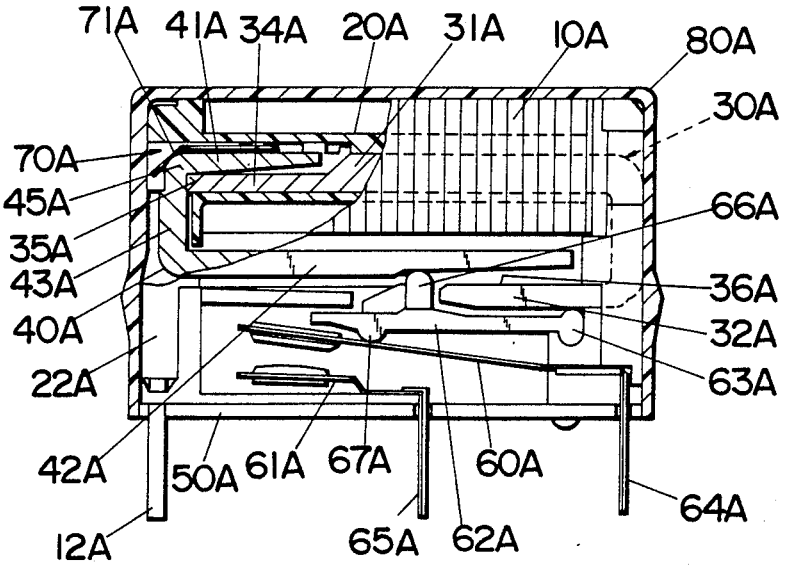
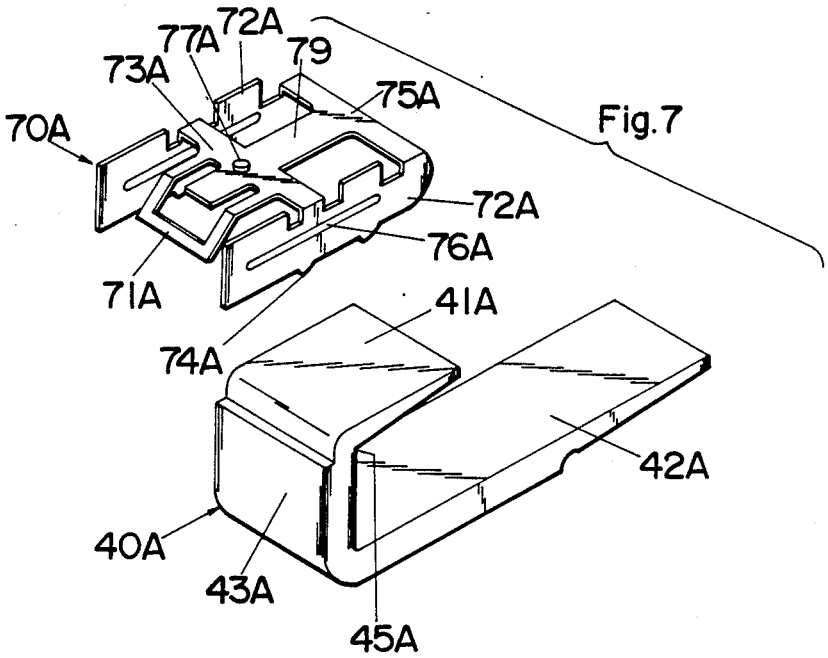
Fig.7

ELECTROMAGNETIC RELAY

BACKGROUND ART

1. Field of the Invention

The present invention is directed to an electromagnetic relay, and more particularly, to such a relay in which an armature and a yoke are magnetically coupled partially within an elongated coil bobbin carrying an excitation coil.

2. Description of the Prior Art

In recent years there has been a growing demand for relays, particularly for power relays which switch a relatively high current but can be made compact enough to be fitted within a limited space. U.S. Pat. Nos. 4,689,587 and 4,720,694 proposed a relay in which an armature and a yoke have their portions inserted respectively within a coil bobbin carrying an excitation coil and are magnetically coupled together within the coil bobbin in order to obtain a compact design for arrangement of the coil bobbin, the armature, and the yoke within a limited space. The armature is pivotally supported on the yoke at a position outwardly of the coil bobbin to be pivotable about a pivot axis between a set position of closing a relay contact and a reset position of opening the relay contact. In order to retain the armature in a proper position for effecting the pivotal movement, a leaf spring is utilized to tie the armature and the yoke together. In this patent, however, since the armature has its pivot axis outside of the coil, the leaf spring is required to be placed exteriorly of the coil bobbin to tie the armature and the yoke at positions outwardly of the coil bobbin. Such spring arrangement adds to the dimensions of the relay assembly and should be avoided for providing a relay as compact as possible. Further, since the leaf spring utilized in the patent is elongated to extend substantially the full length of the yoke and be secured to the armature and the yoke at opposite ends, the leaf spring may have more chances to be deformed in the lengthwise direction at the assembly of the relay as well as at the forming of the spring, which might lead to an unacceptable variations in spring characteristic and fail to give a constant spring bias required to retain the armature at an exact position relative to the yoke for the pivotal movement thereof. For instance, when the spring gives only a weak biasing force the armature will see undesirable shifting of the pivot axis during the pivot movement, and when the spring gives a strong biasing force the armature will be reluctant to move in response to the energization of the coil and therefore have lowered response sensitivity, both of which would result in unstable relay operations and therefore be the causes of increased fraction defective. Consequently, the prior art relay is still found unsatisfactory from the standpoint of providing a more compact design with reliable operational characteristics.

SUMMARY OF THE INVENTION

The present invention eliminates the above-mentioned problems and provides an improved electromagnetic relay. The relay in accordance with the present invention comprises a coil bobbin carrying an excitation coil, a generally U-shaped yoke with first and second yoke members, and a generally U-shaped armature with short and long legs bridged by a web. The coil bobbin is elongated to have an axially extending bore within which the yoke and the armature are coupled with the first yoke member and the short armature leg extending into the axial bore. The first yoke leg terminates within the coil bobbin at a portion adjacent to one longitudinal end of the axial bore to define thereat a first pole end with a pivot edge, while the second yoke member extends outwardly of the excitation coil to define a second pole end. The armature is formed with a bearing edge at an inside corner between the short leg and the web and has the long leg extending outwardly of the excitation coil into a closely adjacent relation to the second pole end of the yoke and operatively connected to a relay contact. The short armature leg extends in an overlying relation with the first pole end of the yoke within the coil bobbin and is pivotally supported thereto with the bearing edge engaging the pivot edge of the first pole end so that the armature is pivotable between a set position and a reset position in response to the energization and deenergization of the excitation coil. Upon energization of the coil, the armature pivots about the pivot edge into the set position where the armature has the short and long legs magnetically attracted respectively to the first and second pole ends for closing the relay contact. Upon deenergization of the coil the armature pivots into the reset position where it has the short and long legs away from the first and second pole ends for opening the relay contact. The relay also include a hinge spring which is fitted into the one end of the bore adjacent the short armature leg in order to urge the bearing edge of the armature against the pivot edge of the yoke for maintaining the bearing edge in a fixed position relative to the pivot edge. In this manner, the axial bore of the coil bobbin is best utilized to incorporate the hinge spring such that the hinge spring will not require a space exteriorly of the excitation coil to thereby maintain whole relay structure at minimum dimensions. Further, since the hinge spring is disposed within the end of the coil bobbin axially outwardly of the armature so as to give a spring force to the armature located axially inwardly of the hinge spring, the hinge spring can be sized small enough to have less variations in spring characteristics and therefore maintain the pivotal connection between the armature and the yoke at an optimum spring force, insuring a reliable and consistent relay operation, in addition to that the hinge spring can be easily assembled last into the bore of the coil bobbin.

Accordingly, it is a primary object of the present invention to provide an improved electromagnetic relay which is capable of being made compact in design, yet insuring reliable operational characteristics.

In a preferred embodiment, the hinge spring is formed as an integral element of a spring fitting which is press fitted into the one end of the coil bobbin. The spring fitting comprises a pair of opposed side plates held against inner side walls of the axial bore and are integrally bridged by a reinforcing bar from which the hinge spring extends for engagement with an external corner of the armature opposite of the bearing edge. With the provision of the reinforcing bar, the dimensional stability of the spring fitting can be assured to retain the hinge spring at a fixed position relative to the coil bobbin and therefore the armature, whereby insuring a desired spring force to be applied to the armature for reliable relay operations. Further, since the hinge spring is spaced by the reinforcing bar from the side plates secured to the coil bobbin, the hinge spring can be substantially free from possible deformation which the side plates may have at the time of inserting the fitting into the bore, and therefore can provide a constant spring characteristic contributing further to the consistent and reliable relay operation.

It is therefore another object of the present invention to provide an improved relay in which the hinge spring is formed as an integral member of a spring fitting to be inserted into the end of the yoke and can give a constant spring force to the armature for consistent pivotal movement of the armature relative to the yoke.

In the above relay structure, it is desirable to have an increased magnetic force developed between the short armature leg and the first pole end for enhanced relay response sensitivity as well as to have the spring fitting which is designed to be as unyieldable as possible. The enhanced relay response sensitivity can be obtained by extending the short leg a greater distance axially inwardly into the axial bore past the reinforcing bar of the spring fitting to have an increased area confronting the first pole end, while the more unyieldable spring fitting can be made by additionally providing an end bar bridging the ends of the opposite side plates positioned axially inwardly of the bore and further by bridging the end bar and the reinforcing bar by a cross bar. However, the cross bar and end bar might be hindrance to and restrict the movement of the extended short armature leg and therefore be not compatible with the above requirement of increasing the response sensitivity. The above two incompatible features can be successfully achieved by the present invention in which the short armature leg is tapered to have its thickness thinner toward the free end thereof so that it can extend inwardly into the axial bore without causing any interference with the cross bar and the end bar of the fittings.

It is therefore a further object of the present invention to provide an improved relay which is capable of increasing response sensitivity, yet assuring to give a more unyieldable structure to the spring fitting.

The present invention further discloses other advantageous features including that the spring fitting is also formed with an integral tab which extends axially rearwardly of the bore and is adapted to be gripped by an automatic pick-and-place device for facilitating automatic assembly of the spring fitting into the bore of the bobbin.

These and still other objects and advantages will be more apparent from the following description of the preferred embodiments when taken in conjunction with the attached drawings.

BRIEF DESCRIPTION OF THE DRAWINGS

FIG. 6 is a side view partly in section of an electromagnetic relay in accordance with a second embodiment of the present invention;

FIG. 7 is an exploded perspective view of a spring fitting and an armature forming the above relay of FIG. 6.

DETAILED DESCRIPTION OF THE PREFERRED EMBODIMENTS

First Embodiment <FIGS. 1 to 5>

Figure 1:
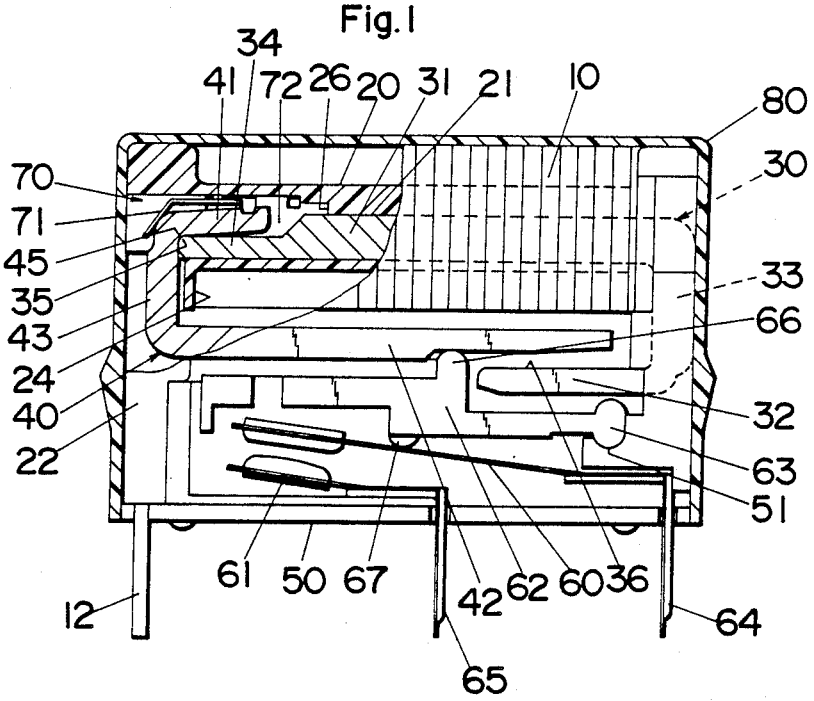
FIG. 1 is a side view partly in section of an electromagnetic relay in accordance with a first embodiment of the present invention.
Figure 2:
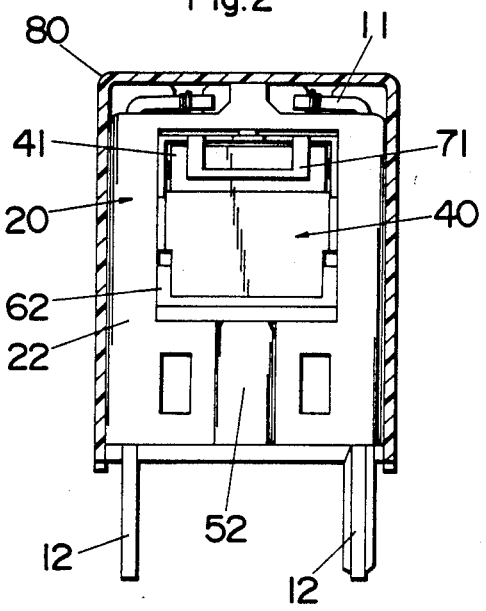
FIG. 2 is an end view of the above relay.
Figure 3:
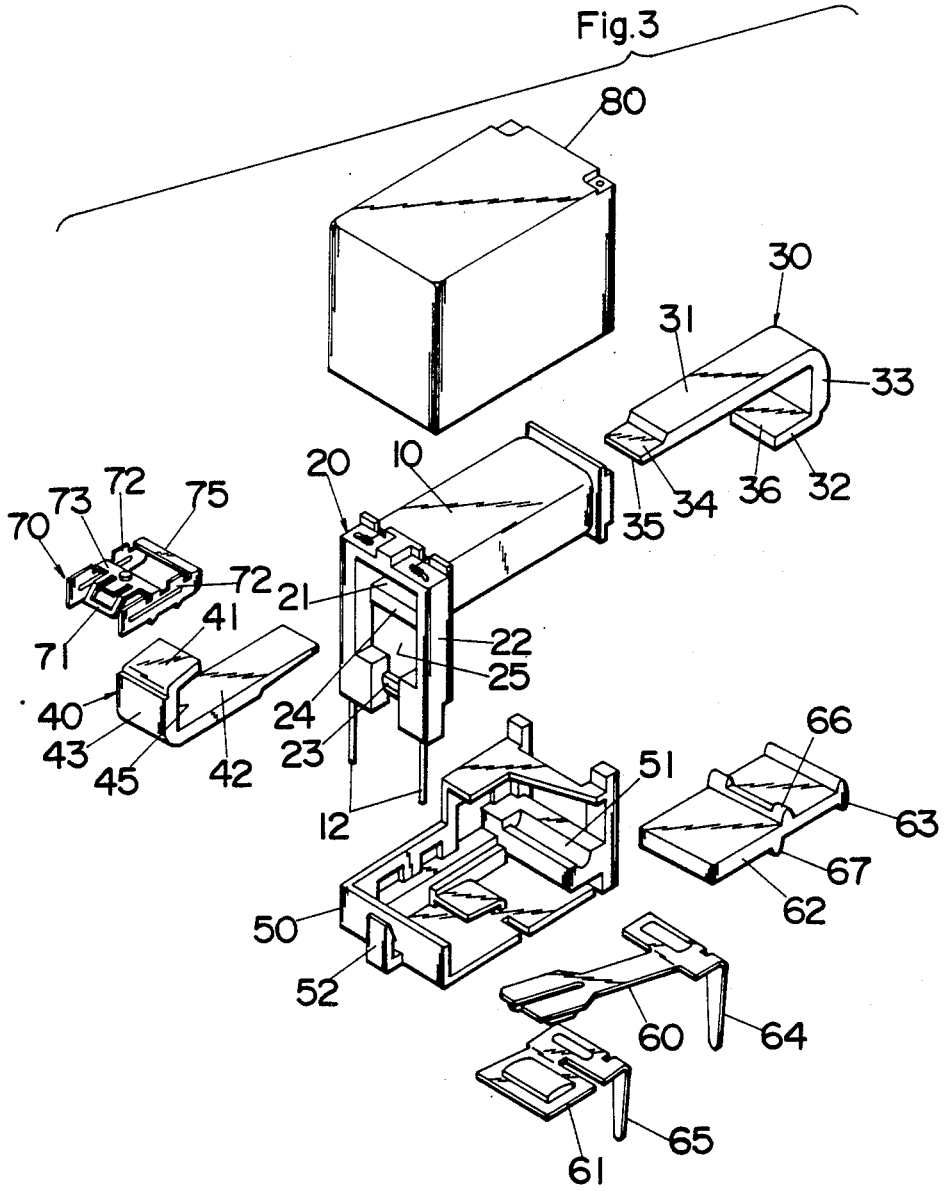
FIG. 3 is an exploded perspective view of the above relay.

Referring now to FIG. 1, an electromagnetic relay in accordance with a first embodiment of the present invention is shown to comprise an excitation coil 10, an generally U-shaped yoke 30, a generally U-shaped armature 40. The excitation coil 10 is wound around an elongated coil bobbin 20 having an axially extending bore 21 into which the yoke 30 and the armature 40 partially extend to be magnetically coupled together within the coil bobbin 20. As shown in FIG. 3, the coil bobbin 10 is formed at its one longitudinal end with an integrally depending extension 22 by which the coil bobbin 10 is held on a base 50 carrying a relay contact composed of a movable contact 60 and a fixed contact 61. The movable contact 60 is operatively connected to the armature 40 through a card 62 to close and open the relay contact in response to the armature movement. The card 62 is also supported on the base 50 with its one end 63 pivotally engaged with a rounded cavity 51 formed at a portion adjacent the fixed end of the movable contact 60. The coil bobbin 10 is secured to the base 50 with a barb projection 52 at one end of the base 50 engaged into a corresponding catch 23 at the lower end of the extension 22 such that the coil bobbin 10 extends horizontally in the upper end of the relay. Extending vertically through the extension 22 are conductor leads 11 which penetrate downwardly through the base 50 to define terminal lugs 12 at the respective lower ends and which project on the upper end of the coil bobbin 20 for wiring with excitation coil 10. The movable and fixed contacts 60 and 61 are connected respectively to terminal lugs 64 and 65 projecting downwardly of the base 50. A cover 80 is fitted over the base 50 to enclose therebetween the components in such a manner that the coil bobbin 20 has its opposite ends abutting respectively with upper end walls of the cover 80.

The U-shaped yoke 30 comprises first and second yoke members 31 and 32 extending generally parallel to one another in the same direction from the opposite end of a web 33, the first yoke member 31 being longer than the second yoke member 32. The yoke 30 is coupled to the coil bobbin 20 with the full length of the first yoke member 31 extending into the axial bore 21 and with the second yoke member 32 extending outwardly of the coil 10 in spaced relation thereto. The free end portion of the first yoke member 31 is recessed to have a reduced thickness and defines thereat a first pole end 34 with a pivot edge 35 at its leading edge, while the second yoke member 32 defines at its free end portion a second pole end 36 spaced downwardly from the coil 10.

The U-shaped armature 40 comprises short and long legs 41 and 42 bridged by a web 43 and extending generally in parallel relation to on another from the opposite ends of the web 43. The armature 40 is coupled to the yoke 30 with the short leg 41 extending into the axial bore 21 of the coil bobbin 10 in an overlying relation to the first pole end 34 of the first yoke member 31 and with the long leg 42 extending outwardly of the coil 10 in an overlying relation with the second pole end 36. It is noted at this time that the coil bobbin 20 is formed at its one end with a downwardly extending flange 24 which is offset inwardly in order to guide the web 43 of the armature 40 outwardly of the flange 24 and receive the same within an opening 25 of the extension 22.

Figure 5A:
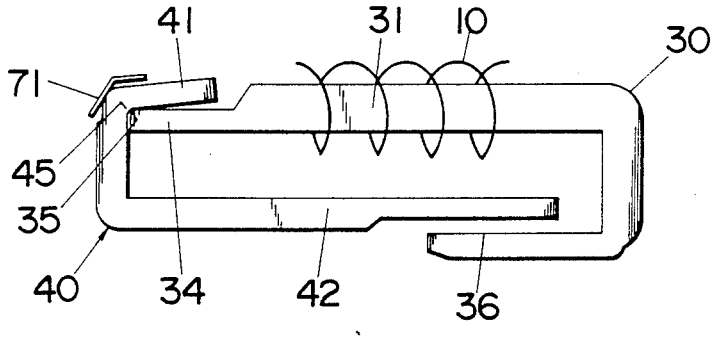
FIGS. 5A and 5B are schematic views illustrating the armature in reset and set positions, respectively.
Figure 5B:
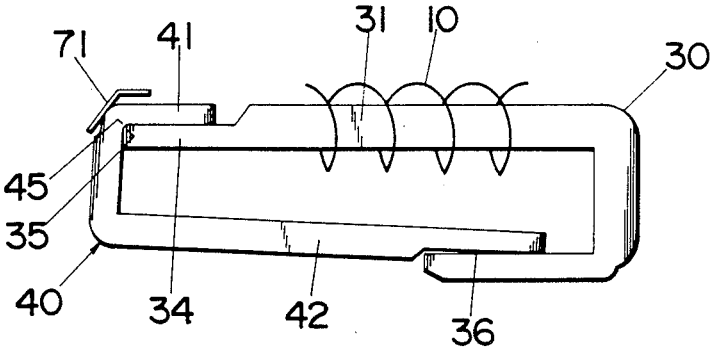

The armature 40 is formed with a bearing edge 45 at the inside corner between the short leg 41 and the web 43 and is pivotally supported to the yoke 30 with that bearing edge 45 held against the pivot edge 35 such that the armature 40 is pivotable between a set position and a reset position in response to the energization and deenergization of the excitation coil 10. In the reset position, as shown in FIG. 1 and FIG. 5A, the short leg 41 is kept spaced from the first pole end 34 except at the pivot connection and the long armature leg 42 is kept spaced from the second pole end 36. When the excitation coil 10 is energized, the armature 40 pivots in a direction of attracting the short and long armature legs 41 and 42 respectively to the first and second pole ends 34 and 36 and is kept at the attracted position, or the set position, as shown in FIG. 5B, until the coil 10 is deenergized. It is noted at this time that the movable contact 60 gives a return bias to move the armature 40 back to the reset position upon deenergization of the coil 10. That is, when the armature 40 pivots into the set position upon energization of the coil 10, it actuates the card 62 to also pivot downwardly so as to force the movable contact 60 against the bias thereof into contact with the fixed contact 61. Upon deenergization of the coil 10, the spring bias accumulated in the movable contact 60 is released to force the movable contact 60 itself out of the fixed contact 61 and at the same time to return the card 62 and the armature 40 into the reset position. As shown in FIG. 1, the card 62 is held between the long armature leg 42 and the movable contact 60 with rounded projections 66 and 67 abutting thereagainst, respectively.

Figure 4:
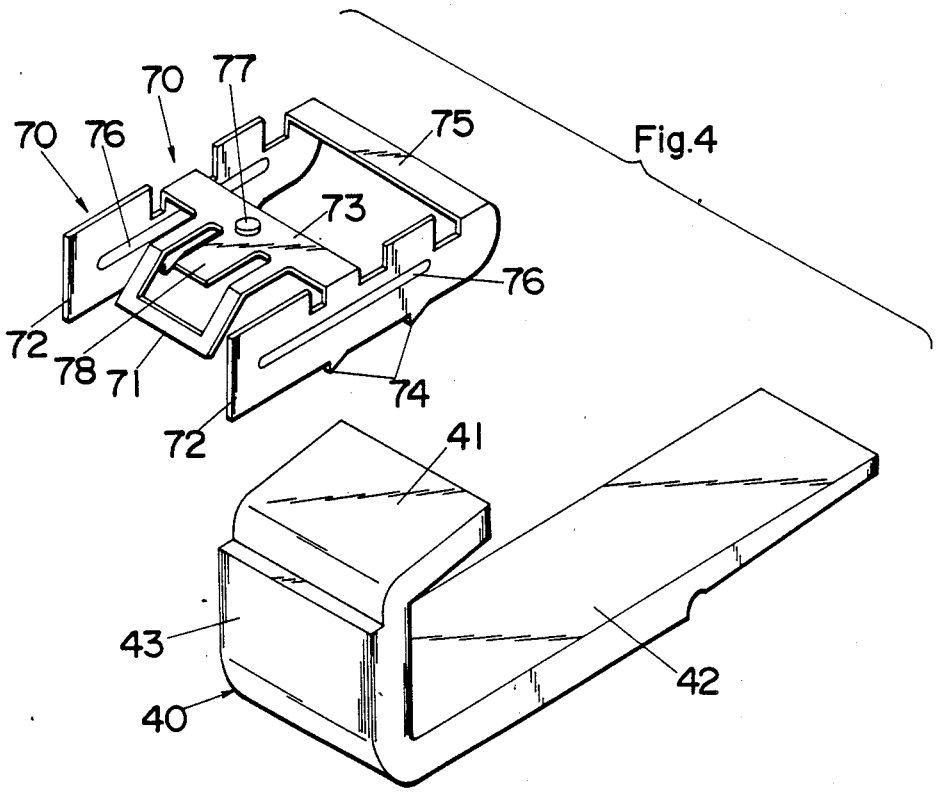
FIG. 4 is an exploded perspective view of a spring fitting and an armature forming the above relay.

To retain the armature 40 at an exact position relative to the yoke 30, a spring fitting 70 with a hinge spring 71 is fitted into the axial bore 21 adjacent to the short armature leg 41 so that the hinge spring 71 is pressed against the external corner of the armature 40 to urge the bearing edge 45 against the pivot edge 35 of the yoke 30 at an optimum pressure. As best shown in FIG. 4, the spring fitting 70 is of unitary construction stamped and formed from a flat metal blank to have a pair opposed side plates 72 integrally bridged by a center bar 73 from which the hinge spring 71 extends rearwardly and downwardly. The hinge spring 71 is in the form of a U-shaped element having a laterally extending segment joined to the center bar 73 through a pair of opposed side segments such that the hinge spring 71 is pressed upon the external corner of the armature 40 at laterally spaced positions by the individual side segments. The side plates 72 of the fitting 70 are each formed on its lower edge with barb projections 74 which bite into the bottom wall of the bore 21 for firm placement of the fitting 70 within the coil bobbin 20. The fitting 70 is inserted into the bore 21 with the side plates 72 guided along the inner side walls of the bore 21 until the forward edge of the fitting 70 engages with a notch 26 formed in the upper inside wall of the bore 21 inwardly of the first pole end 34. When the fitting 70 is thus inserted, the side plates 72 are held against the opposed inner side walls of the bore 21 with the projections 74 biting the inner bottom wall of the bore 21 so that the fitting 70 is held at a fixed position where the hinge spring 71 comes into engagement with the external corner of the armature 40, as shown in FIG. 1, so as to urge the bearing edge 45 of the armature 40 against the pivot edge 35 of the yoke 30 at an optimum pressure, thereby permitting the armature 40 to pivot about a fixed pivot axis between the set and reset position without causing any substantial fluctuation. The center bar 73 bridging the side plates 72 acts to reinforce the fitting 70 to give increased dimensional stability thereof and therefore to prevent the hinge spring 71 from being unintendedly deformed at the time of inserting the fitting 70. For the same reinforcing purpose, an end bar 75 is also formed to bridge the side plates 72 at the inner most ends thereof. The center and end bars 73 and 75 are spaced to define therebetween an open space into which the end of the short armature leg 41 is allowed to extend when the armature 40 is in the reset position. Further, each of the side plates 72 has a depressed longitudinal rib 76 for increased strength. It is noted at this time that the center bar 73 has a stud 77 which abuts against the upper inside wall of the bore 21 for exact positioning of the fitting 70 within the bore 21 as well as for preventing the hinge spring 71 from contacting with the upper bottom wall of the bore 21, thereby maintaining the hinge spring 71 at a condition for giving a constant spring bias to the pivot connection between the armature 40 and the yoke 30. The stud 77 may be rounded to have a point contact with the upper inside wall of the bore 21. Further, the above structure of the fitting 70 in which the hinge spring 71 extends from the center bar 73 is found advantageous in that the hinge spring 71 can be substantially free from any minor deformation which the side plates 72 may have at the time of inserting the fitting 70 into the coil bobbin 20, and can be therefore kept harmless to maintain a constant spring characteristic.

The fitting 70 is also formed with a tab 78 extending horizontally and rearwardly from the center bar 73. The tab 78 is adapted to be gripped by an automatic pick-and-place machine for facilitating the insertion of the fitting 70 into the bore 21 in an automatic relay assembly. In this respect, the relay structure of the present invention allows the fitting 70 to be inserted last after assembling the yoke 30 and the armature 40 to the coil bobbin 20.

Second Embodiment <FIGS. 6 and 7>

FIGS. 6 and 7 illustrates an electromagnetic relay in accordance with a second embodiment of the present invention which is identical in structure to the first embodiment except for detailed configurations of a spring fitting and an armature. The like parts are designated by like numerals with a suffix letter of "A". In this embodiment, the fitting 70A is further formed with a cross bar 79 integrally bridging a center bar 73A and an end bar 75A for further reinforcing the fitting 70A and enhancing the dimensional stability thereof. The short armature leg 41A is configured to extend to a greater extent than that of the first embodiment so as to have an increased area confronting the first pole end 34A and therefore to obtain a correspondingly greater attraction force developed therebetween for enhanced response sensitivity. To avoid the jamming of thus elongated armature leg 41A with the cross bar 79 at the reset position of the armature 40A, the armature leg 41A is tapered to have a thickness thinner toward the end such that the armature leg, or the tapered end 41A will not interfere with the cross bar 79 when the armature 40A pivots to the reset position. With this arrangement, the armature 40A can have improved response sensitivity without sacrificing the armature stroke, while allowing the use of the spring fitting 70A with enhanced dimensional stability.

Figure 8:
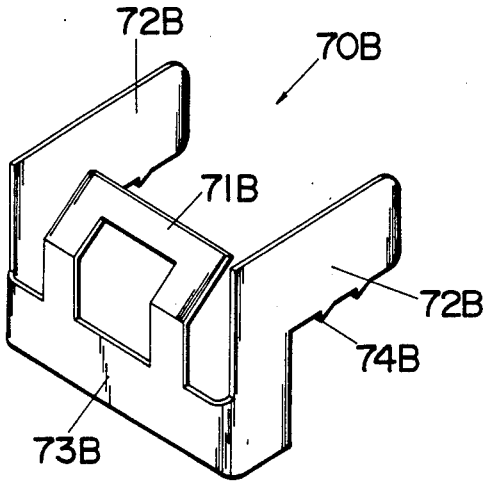
FIGS. 8 and 9 are perspective views of modified spring fittings which may be employed in the present invention.
Figure 9:
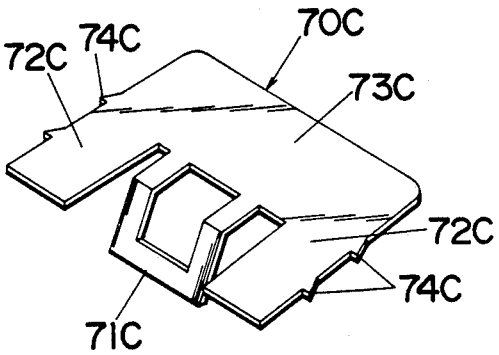

Although the spring fittings 70 and 70A in the first and second embodiments are preferable, the present invention should not be understood to be limited thereto and may utilize spring fittings of different configurations as shown in FIGS. 8 and 9. The spring fitting 70B shown in FIG. 8 is likewise of unitary construction formed form a flat metal blank to have a pair of side plates 72B, a lateral bar 73B bridging the lower ends of the side plate 72B, and a like hinge spring 71B extending upwardly and inwardly from the lateral bar 73B. The fitting 70B thus configured is inserted in the axial bore of the coil bobbin and is secured thereto, in the like manner as in the first embodiment, by pressing the side plates 72B against the inner side walls of the bore and engaging barb projections 74B into the lower bottom wall of the bore of the coil bobbin. The fitting 70C shown in FIG. 9 is of simpler unitary construction comprising a U-shaped flat plate having side sections 72C on the opposite ends of a center section 73C from which a like hinge spring 71C extends rearwardly and downwardly in the like manner as in the first embodiment. The fitting 70C is inserted into and fixed to the axial bore of the coil bobbin with the side sections 72C pressed against the inner side walls of the bore and with barb projections 74C on the side edges of the sections 72C engaging into the inner side walls of the bore Also in the above modified fittings 70B and 70C, the hinge spring 71B and 71C can be relatively free from deformation which the side plates or sections 72B, 72C receive at the time of inserting the fitting into the bore of the coil bobbin to thereby retain a desired spring characteristic required for exact positioning of the armature about the pivot axis to the yoke.

What is claimed is:

1. An electromagnet relay comprising:

an elongated coil bobbin having an axially extending bore and carrying therearound an excitation coil;

a generally U-shaped yoke with opposed first and second yoke members, said yoke magnetically coupled to said excitation coil with said first yoke member extending into said axial bore and with said second yoke member extending outwardly of said excitation coil, said first yoke member terminating at a portion adjacent one longitudinal end of said axial bore to define thereat a first pole end with a pivot edge, and said second yoke member defining a second pole end at its end spaced from said coil;

a generally U-shaped armature having short and long legs connected by a web and defining a bearing edge at an inner corner formed between the short leg and the web, said long leg extending outwardly of said excitation coil to have its free end portion in an adjacent relation to said second pole end, said short leg extending into said axial bore in an overlying relation with said first pole end of said first yoke member with said bearing edge supported on said pivot edge such that said armature is pivotable about said pivot edge between a set position where said short and long legs are magnetically attracted respectively to said first and second pole ends upon energization of said excitation coil and a reset position where said short and long legs are kept respectively away from said first and second pole ends;

a movable contact operatively connected to said armature to be driven thereby to come into and out of contact with a complementary contact in response to said armature movement between the set and reset positions; and a hinge spring held in said one end of the axial bore adjacent to and axially outwardly of said short leg of the armature so as to urge said bearing edge of against said pivot edge for providing a fixed pivot axis about which said armature pivots between said set and reset positions.

2. An electromagnetic relay as set forth in claim 1, wherein said movable contact gives a return bias to move said armature into the reset position upon deenergization of said excitation coil.

3. An electromagnetic relay as set forth in claim 1, wherein said hinge spring is formed as an integral part of a spring fitting which is press fitted into said one end of the axial bore and secured thereto, said fitting comprising a pair of opposed side plates held against opposed inner side walls of said axial bore, said side plates being bridged by a reinforced bar from which said hinge spring extends.

4. An electromagnetic relay as set forth in claim 1, wherein said short armature leg is tapered to have a thickness thinner toward the free end thereof.

5. An electromagnetic relay as set forth in claim 3, wherein said short armature leg is tapered to have a thickness thinner toward the free end thereof, and said fitting is formed with an end bar integrally bridging said side plates at their ends opposite of said reinforcing bar from said hinge spring, said end bar and said reinforcing bar integrally bonded by a cross bar, and said tapered short armature leg extending into said axial bore to a position past said reinforcing bar and adjacent said end bar without causing interference with said cross bar.

6. An electromagnetic relay as set forth in claim 3, wherein said fitting is provided at a portion other than said hinge spring with a stud which abuts against the inner wall of said axial bore to maintain said hinge spring spaced from inner wall of said axial bore.

7. An electromagnetic relay as set forth in claim 3, wherein said metal fitting is provided with a tab which is adapted to be gripped by a suitable tool for automatic assembly of said spring fitting into said axial bore.

8. An electromagnetic relay as set forth in claim 3, wherein each of said side plates is provided with a depressed and longitudinally extending rib for providing increased strength to said side plate.

* * * * *